US008319707B2

(12) United States Patent
Kwon

(10) Patent No.: US 8,319,707 B2
(45) Date of Patent: Nov. 27, 2012

(54) ORGANIC LIGHT EMITTING DISPLAY AND DRIVING METHOD THEREOF

(75) Inventor: Oh-Kyong Kwon, Seoul (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 837 days.

(21) Appl. No.: 12/080,955

(22) Filed: Apr. 8, 2008

(65) Prior Publication Data

US 2008/0252568 A1 Oct. 16, 2008

(30) Foreign Application Priority Data

Apr. 10, 2007 (KR) ..... 10-2007-0035012

(51) Int. Cl.
*G09G 3/30* (2006.01)

(52) U.S. Cl. ..... 345/76; 345/77; 315/169.3

(58) Field of Classification Search ..... 345/76–102; 315/169.3
See application file for complete search history.

(56) References Cited

U.S. PATENT DOCUMENTS

| | | | | |
|---|---|---|---|---|
| 6,911,781 | B2 * | 6/2005 | Yamazaki et al. | 315/169.3 |
| 7,456,812 | B2 | 11/2008 | Smith et al. | |
| 2005/0179625 | A1 | 8/2005 | Choi et al. | |
| 2006/0139264 | A1 | 6/2006 | Choi et al. | |
| 2007/0018917 | A1 | 1/2007 | Miyazawa | |
| 2008/0001854 | A1 | 1/2008 | Hamer et al. | |
| 2008/0036703 | A1 | 2/2008 | Wang et al. | |
| 2008/0224962 | A1 | 9/2008 | Kasai et al. | |
| 2008/0252571 | A1 | 10/2008 | Hente et al. | |

FOREIGN PATENT DOCUMENTS

| | | | |
|---|---|---|---|
| JP | 2004-145257 | A | 5/2004 |
| JP | 2005-128272 | A | 5/2005 |
| JP | 2005-258427 | A | 9/2005 |
| JP | 2005-309230 | A | 11/2005 |
| JP | 2006-058352 | A | 3/2006 |
| JP | 2006-058352 | A | 4/2006 |
| JP | 2007-052202 | A | 3/2007 |
| JP | 2007-140325 | A | 6/2007 |
| KR | 10-2005-0049320 | A | 5/2005 |
| KR | 10-2005-0052332 | A | 6/2005 |
| KR | 10-2006-0029062 | A | 4/2006 |
| KR | 10-2006-0112993 | A | 11/2006 |
| KR | 10-2006-0132795 | A | 12/2006 |
| KR | 10-2007-0000422 | A | 1/2007 |
| KR | 10-2007-0019882 | A | 2/2007 |

OTHER PUBLICATIONS

Notice of Allowance from Korean Patent Office issued on Jun. 26, 2008 in KR 10-2007-0035012.

(Continued)

*Primary Examiner* — Kevin M Nguyen
*Assistant Examiner* — Kenneth B Lee, Jr.
(74) *Attorney, Agent, or Firm* — Knobbe Martens Olson & Bear, LLP

(57) ABSTRACT

An organic light emitting display capable of displaying an image with uniform luminance regardless of deterioration of an organic light emitting diode and threshold voltage and/or mobility of a drive transistor is disclosed. The organic light emitting display senses deterioration of the organic light emitting diode and threshold voltage and/or mobility of a drive transistor and modifies the data supplied to the pixel according to the sensed parameters.

16 Claims, 8 Drawing Sheets

OTHER PUBLICATIONS

Korean Office Action dated Aug. 29, 2008 for Korean Patent Application No. KR 10-2007-0035011 corresponding to U.S. Appl. No. 12/082,147, filed Apr. 8, 2008, which is related to the captioned application.

Korean Notice of Allowance dated Jun. 26, 2008 for Korean Application No. KR 10-2007-0035009 corresponding to U.S. Appl. No. 12/080,956, filed Apr. 8, 2008, which is related to the captioned application.

Korean Office Action dated Aug. 29, 2008 for Korean Patent Applications No. KR 10-2007-0028166 corresponding to U.S. Appl. No. 12/077,828, filed Mar. 21, 2008, which is related to the captioned application.

Office Action dated Aug. 17, 2011 for U.S. Appl. No. 12/080,956, filed Apr. 8, 2008, which is related to captioned U.S. Appl. No. 12/080,955.

Office Action dated Aug. 4, 2011 for U.S. Appl. No. 12/082,147, filed Apr. 8, 2008, which is related to captioned U.S. Appl. No. 12/080,955.

Office Action dated Aug. 10, 2011 for U.S. Appl. No. 12/077,828, filed Mar. 21, 2008, which is related to captioned U.S. Appl. No. 12/080,955.

Office Action dated Mar. 28, 2012 for U.S. Appl. No. 12/077,828, filed Mar. 21, 2008, which is related to captioned U.S. Appl. No. 12/080,955.

* cited by examiner

ORGANIC LIGHT EMITTING DISPLAY AND DRIVING METHOD THEREOF

CROSS-REFERENCE TO RELATED APPLICATIONS

This application claims the benefit of Korean Patent Application No. 10-2007-0035012, filed on Apr. 10, 2007, in the Korean Intellectual Property Office, the disclosure of which is incorporated herein by reference.

BACKGROUND

1. Field

The field relates to an organic light emitting display and a driving method thereof, and more particularly to an organic light emitting display capable of displaying an image with uniform luminance regardless of deterioration of an organic light emitting diode and threshold voltage and/or mobility of a drive transistor, and a driving method thereof.

2. Discussion of Related Technology

In recent years, a variety of flat panel displays of reduced weight and volume when compared to cathode ray tube have been developed and commercialized. A flat panel display may take the form of a liquid crystal display (LCD), a field emission display (FED), a plasma display panel (PDP), an organic light emitting display (OLED), etc.

Among the flat panel displays, the organic light emitting display uses an organic light emitting diode to display an image, the organic light emitting diode generating light by means of the recombination of electrons and holes. Such an organic light emitting display has advantages in that it has a rapid response time and is also driven with low power consumption.

FIG. 1 is a circuit view showing a pixel of a conventional organic light emitting display.

Referring to FIG. 1, the pixel 4 includes an organic light emitting diode (OLED), data lines (Dm) and a pixel circuit 2 connected to the scan lines (Sn) to control the organic light emitting diode (OLED).

An anode electrode of the organic light emitting diode (OLED) is connected to the pixel circuit 2, and a cathode electrode is connected to the second power source (ELVSS). Such an organic light emitting diode (OLED) generates a predetermined luminance to correspond to an electric current supplied from the pixel circuit 2.

The pixel circuit 2 controls an electric current supplied to the organic light emitting diode (OLED) to correspond to a data signal supplied to the data lines (Dm) when a scan signal is supplied to the scan lines (Sn). For this purpose, the pixel circuit 2 includes a second transistor (M2) connected between the first power source (ELVDD) and the organic light emitting diode (OLED); a first transistor (M1) connected between the second transistor (M2) and the data lines (Dm) and the scan lines (Sn); and a storage capacitor (Cst) connected between a gate electrode and a first electrode of the second transistor (M2).

A gate electrode of the first transistor (M1) is connected to the scan lines (Sn), and a first electrode is connected to the data lines (Dm). A second electrode of the first transistor (M1) is connected to one side terminal of the storage capacitor (Cst). Here, the first electrode is either a source electrode or a drain electrode, and the second electrode is the electrode which is different from the first electrode. For example, if the first electrode is a source electrode, the second electrode is a drain electrode. When a scan signal is supplied from the scan lines (Sn), the first transistor (M1) connected to the scan lines (Sn) and the data lines (Dm) is turned on to supply the data signal, supplied from the data lines (Dm), to the storage capacitor (Cst). At this time, the storage capacitor (Cst) charges a voltage corresponding to the data signal.

The gate electrode of the second transistor (M2) is connected to one terminal of the storage capacitor (Cst), and the first electrode is connected to the other terminal of the storage capacitor (Cst) and the first power source (ELVDD). The second electrode of the second transistor (M2) is connected to the anode electrode of the organic light emitting diode (OLED). The second transistor (M2) controls the electric current according to a voltage value stored in the storage capacitor (Cst), the electric current flowing from the first power source (ELVDD) to the second power source (ELVSS) via the organic light emitting diode (OLED). The organic light emitting diode (OLED) generates the light corresponding to the electric current supplied from the second transistor (M2).

However, an organic light emitting display having a pixel such as that of FIG. 1 has a disadvantage that it is difficult to display an image having a desired luminance due to the changes in current caused by the deterioration of the organic light emitting diode (OLED). The organic light emitting diode deteriorates with the passage of time, and therefore generates light having a gradually weakening luminance despite receiving the same level of a data signal. Also, the conventional organic light emitting display has a problem that it does not display an image having a uniform luminance due to non-uniformity in the threshold voltage and/or mobility of the drive transistors (M2) in each of the pixels 4.

SUMMARY OF CERTAIN INVENTIVE ASPECTS

One aspect is an organic light emitting display, including a plurality of pixels arranged near intersections of data lines, scan lines, power lines, and light emitting control lines. The display also includes a scan driver configured to supply a scan signal to the scan lines and to supply a light emitting control signal to the light emitting control lines, a control line driver configured to supply a control signal to control lines, a data driver configured to generate a data signal for the data lines, and a sensing unit configured to sense information about at least one of deterioration of an organic light emitting diode, voltage threshold of a drive transistor, and mobility of the drive transistor via feedback lines, the organic light emitting diode and the drive transistor being in each of the pixels. The display also includes a control block configured to store the sensed information, and a timing controller configured to generate the second data based on the sensed information and a first data supplied from another circuit.

Another aspect is a method for driving an organic light emitting display. The method includes supplying a data signal to each of a plurality of pixels, generating a first digital value based on an electric current flowing from a drive transistor to a feedback line in response to the data signal, storing the generated first digital value in a memory, generating a second digital value based on electric current to the organic light emitting diode in each of the pixels, and storing the generated second digital value in the memory, and generating a second data based on a first data received from another circuit and on the first and second digital values, where the second data has a greater number of bits than the first data.

BRIEF DESCRIPTION OF THE DRAWINGS

These and/or other aspects and advantages will become apparent and more readily appreciated from the following description of embodiments, taken in conjunction with the accompanying drawings of which.

DETAILED DESCRIPTION OF CERTAIN INVENTIVE EMBODIMENTS

Figure 1:
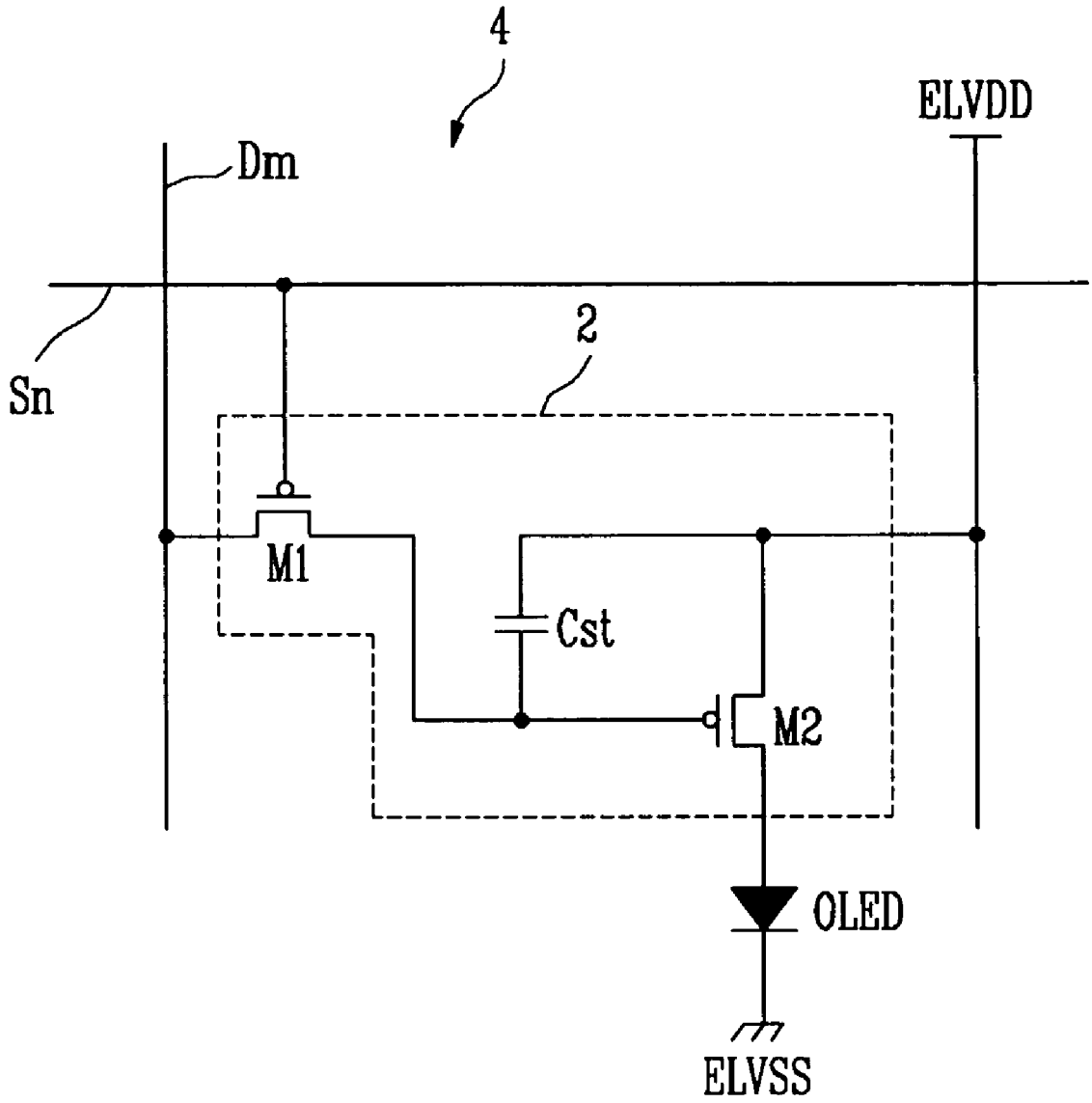
FIG. 1 (PRIOR ART)
FIG. 1 is a circuit diagram showing pixels of a conventional organic light emitting display.

Hereinafter, certain embodiments will be described with reference to the accompanying drawings. Herein, when one element is connected to another element, one element may be not only directly connected to another element but also indirectly connected to another element via another element. Further, irrelative elements may be omitted for clarity. Also, like reference numerals generally refer to like elements throughout.

Figure 2:
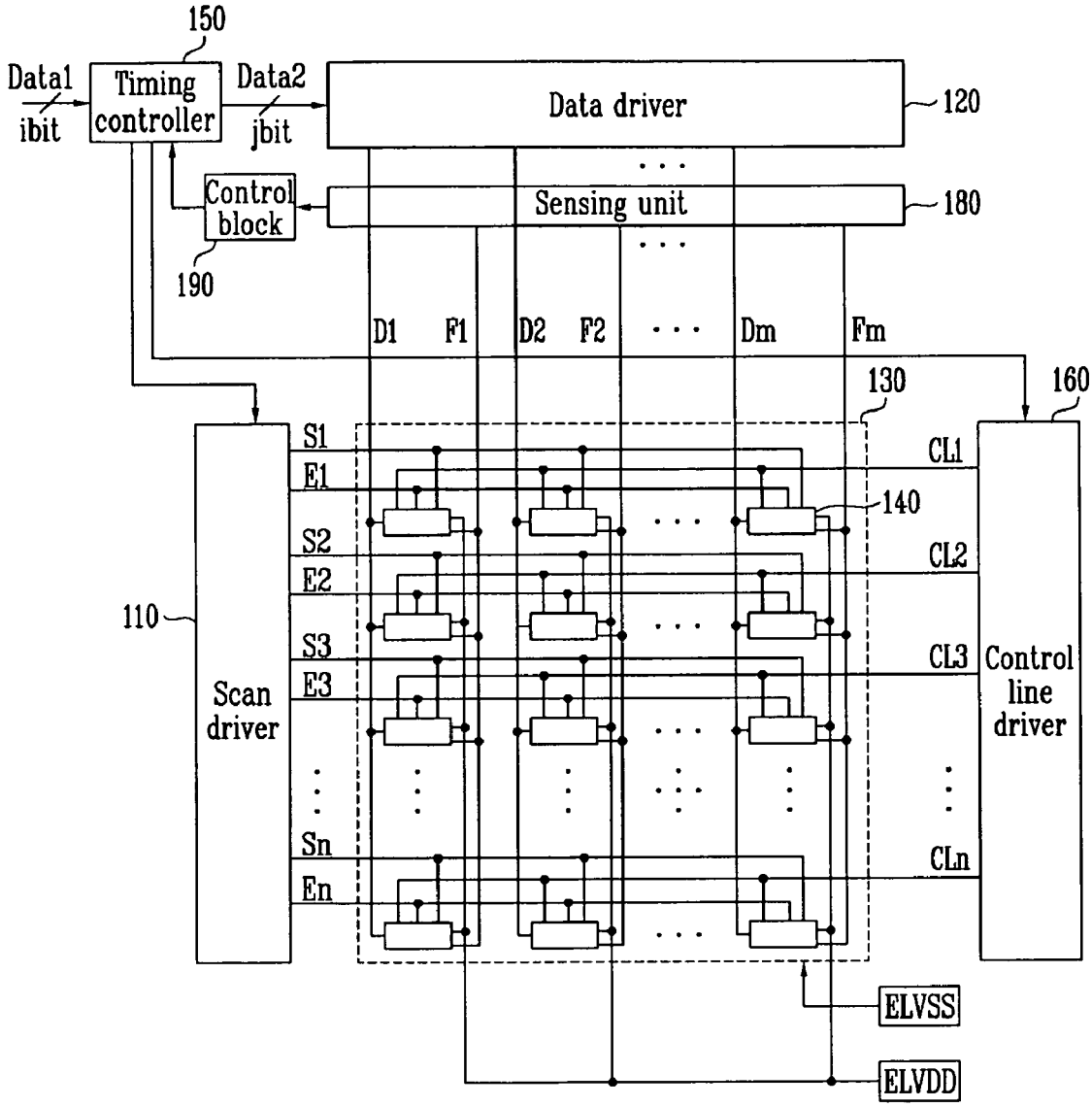
FIG. 2 is a block diagram showing an organic light emitting display according to one embodiment.

FIG. 2 is a diagram showing an organic light emitting display according to one embodiment.

Referring to FIG. 2, an organic light emitting display includes pixels 140 connected to scan lines (S1 to Sn), light emitting control lines (E1 to En), data lines (D1 to Dm), and feedback lines (F1 to Fm); a scan driver 110 for driving the scan lines (S1 to Sn) and the light emitting control lines (E1 to En); a control line driver 160 for driving control lines (CL1 to CLn); a data driver 120 for driving the data lines (D1 to Dm); and a timing controller 150 for controlling the scan driver 110, the data driver 120, and the control line driver 160.

Also, the organic light emitting display according to one embodiment of the present invention further includes a sensing unit 180 for extracting the information about the deterioration of the organic light emitting diode and the threshold voltage/mobility of the drive transistor using the feedback line (F1 to Fm), the organic light emitting diode and the drive transistor being included in each of the pixels 140; and a control block 190 for storing the information sensed in the sensing unit 180.

The pixel unit 130 includes pixels 140 arranged near intersecting points of the scan lines (S1 to Sn), the light emitting control lines (E1 to En), the power lines (V1 to Vm), and the data lines (D1 to Dm). The pixels 140 receives a first power source (ELVDD) and a second power source (ELVSS). The pixels 140 control an electric current according to the data signal, the electric current flowing from the first power source (ELVDD) to the second power source (ELVSS) via the organic light emitting diode. Accordingly, light having a desired luminance is generated in the organic light emitting diode.

The scan driver 110 supplies a scan signal to the scan lines (S1 to Sn) according to the control of the timing controller 150. Also, the scan driver 110 supplies a light emitting control signal the light emitting control lines (E1 to En) according to the control of the timing controller 150.

The control line driver 160 sequentially supplies a control signal to the control lines (CL1 to CLn) according to the control of the timing controller 150.

The data driver 120 supplies a data signal to the data lines (D1 to Dm) according to the control of the timing controller 150.

The sensing unit 180 extracts information of deterioration of the organic light emitting diode in each of the pixels 140, and supplies the extracted information to the control block 190. Also, the sensing unit 180 extracts information of threshold voltage and/or mobility of the drive transistor included in each of the pixels 140, and supplies the extracted information to the control block 190.

The control block 190 stores the information about the deterioration of the organic light emitting diode and the threshold voltage and/or mobility of the drive transistor for each of the pixels 140. For this purpose, the control block 190 includes a memory; and a controller for transmitting the information stored in the memory to the timing controller 150.

The timing controller 150 controls the data driver 120, the scan driver 110, and the control line driver 160. Also, the timing controller 150 generates a second data (Data2) based on a first data (Data1) input from another circuit and on the information supplied from the control block 190. Here, the first data (Data1) is has i bits (i is an integer), and the second data (Data2) has j bits (j is integer greater than i).

The second data (Data2) stored in the timing controller 150 is supplied to the data driver 120. Then, the data driver 120 uses the second data (Data2) to generate a data signal, and supplies the generated data signal to the pixels 140.

Figure 3:
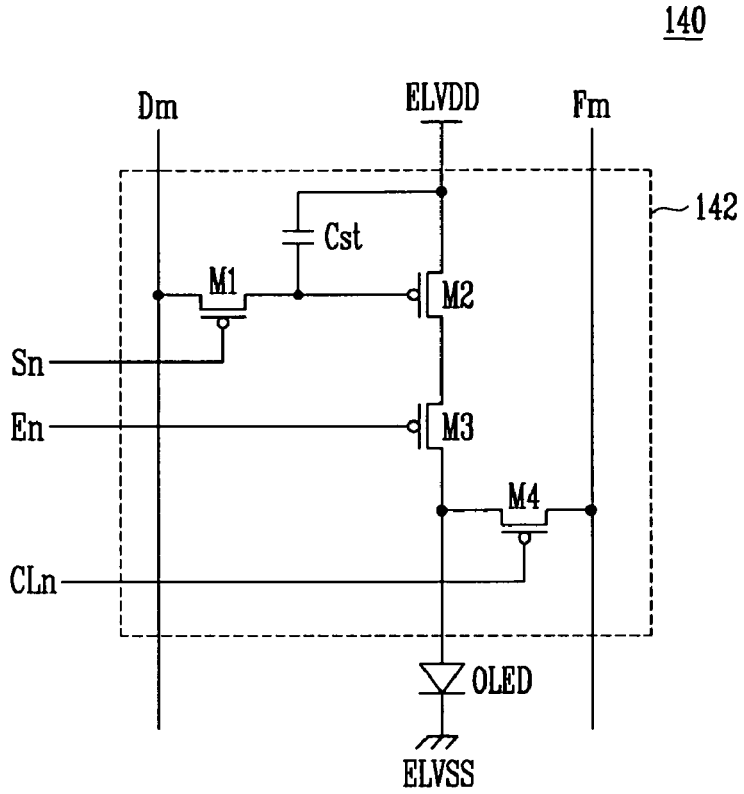
FIG. 3 is a circuit diagram showing one embodiment of the pixels as shown in FIG. 2.

FIG. 3 is a diagram showing one embodiment of the pixels as shown in FIG. 2. As shown in FIG. 3, assume that the pixel is connected to an $m^{th}$ data line (Dm) and an $n^{th}$ scan line (Sn) for convenience's sake of its description.

Referring to FIG. 3, the pixel 140 includes an organic light emitting diode (OLED); and a pixel circuit 142 for supplying an electric current to the organic light emitting diode (OLED).

An anode electrode of the organic light emitting diode (OLED) is connected to the pixel circuit 142, and a cathode electrode is connected to the second power source (ELVSS). The organic light emitting diode (OLED) generates light having a predetermined luminance according to the electric current supplied from the pixel circuit 142.

The pixel circuit 142 receives a data signal for the data line (Dm) when a scan signal is supplied to the scan line (Sn). Also, the pixel circuit 142 supplies at least one of the information of the deterioration of the organic light emitting diode (OLED) and the threshold voltage and/or mobility of the drive transistor (a second transistor (M2)) to the sensing unit 180 when a control signal is supplied to the control line (CLn). For this purpose, the pixel circuit 142 includes 4 transistors (M1 to M4) and a storage capacitor (Cst).

The gate electrode of the first transistor (M1) is connected to the scan line (Sn), and a first electrode is connected to the data line (Dm). A second electrode of the first transistor (M1) is connected to a first terminal of the storage capacitor (Cst). The first transistor (M1) is turned on when a scan signal is supplied to the scan line (Sn).

A gate electrode of the second transistor (M2) is connected to a first terminal of the storage capacitor (Cst), and a first electrode is connected to a second terminal of the storage capacitor (Cst) and the first power source (ELVDD). The second transistor (M2) controls an electric current according to the voltage value stored in the storage capacitor (Cst), the electric current flowing from the first power source (ELVDD) to the second power source (ELVSS) via the organic light emitting diode (OLED). In response, the organic light emitting diode (OLED) generates light corresponding to the electric current supplied from the second transistor (M2).

The gate electrode of the third transistor (M3) is connected to the light emitting control line (En), and a first electrode is connected to the second electrode of the second transistor (M2). The second electrode of the third transistor (M3) is connected to the organic light emitting diode (OLED). The third transistor (M3) is turned off when a light emitting control signal is supplied to the light emitting control line (En), and turned on when the supply of the light emitting control signal is suspended.

The gate electrode of the fourth transistor (M4) is connected to the control line (CLn), and a first electrode is connected to the anode electrode of the organic light emitting diode (OLED). Also, a second electrode of the fourth transistor (M4) is connected to the feedback line (Fm). The fourth transistor (M4) is turned on when a control signal is supplied to the control line (CLn).

Figure 4:
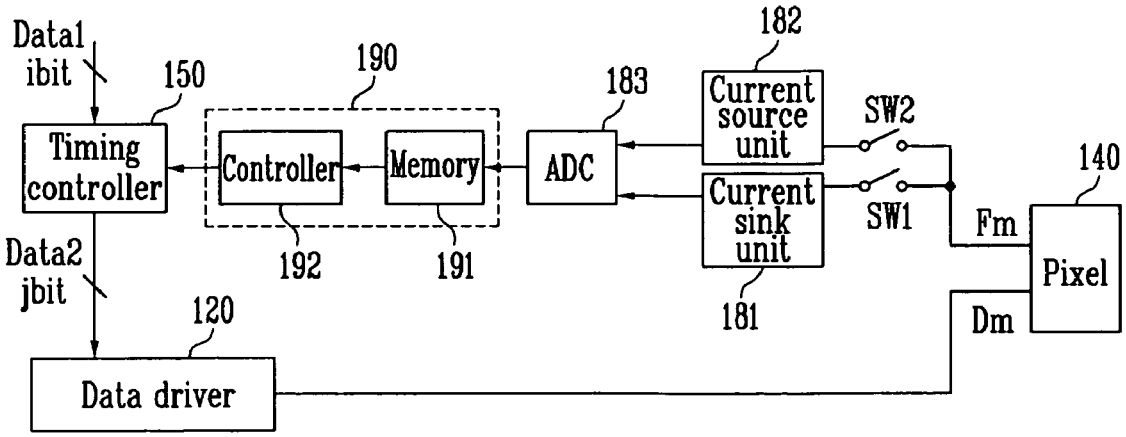
FIG. 4 is a block diagram showing a sensing unit and a control block as shown in FIG. 2.

FIG. 4 is a diagram showing a sensing unit and a control block shown in FIG. 2. As shown in FIG. 4, the sensing unit and the control block are connected to an $m^{th}$ feedback line (Fm) for convenience's sake of description.

Referring to FIG. 4, each of the channels of the sensing unit 180 includes a first switching element (SW1), a second switching element (SW2), an electric current sink unit 181, an electric current source unit 182, and an analog-digital converter (hereinafter, referred to as "ADC") 183. One ADC may be shared by one or all of a plurality of channels. The control block 190 includes a memory 191 and a controller 192.

The first switching element (SW1) is arranged between the electric current sink unit 181 and the feedback line (Fm). The first switching element (SW1) is turned on when the information of the threshold voltage and/or mobility of the second transistor (M2) included in the pixel 140.

The second switching element (SW2) is arranged between the electric current source unit 182 and the feedback line (Fm). The second switching element (SW2) is turned on when the information of the deterioration of the organic light emitting diode (OLED) included in the pixel 140.

The electric current sink unit 181 receives an electric current from the pixel 140, and senses information of the threshold voltage and/or mobility of the second transistor (M2) using the supplied electric current. More particularly, a certain data signal is supplied to the pixel 140 during a period when the information of the threshold voltage and/or mobility of the second transistor (M2) is sensed. The electric current sink unit 181 senses the information of the threshold voltage and/or mobility while sensing a first voltage corresponding to the electric current supplied from the pixel 140 generated by the pixel 140 in response to the certain data signal. Ideally, the same electric current should flow in each of the pixels 140 according to the certain data signal. However, deviation of the electric current supplied to the electric current sink unit 181, i.e., deviation of the first voltage, occurs in each of the pixels 140 due to the deviation in the threshold voltage and/or mobility of the second transistor (M2). The electric current sink unit 181 senses the information of the threshold voltage and/or mobility using the first voltage.

The electric current source unit 182 senses the information of the deterioration of the organic light emitting diode (OLED) while supplying a constant electric current to the pixel 140 by sensing a second voltage of the organic light emitting diode (OLED) when the constant electric current is supplied.

More particularly, the value of the second voltage of the organic light emitting diode (OLED) varies as the organic light emitting diode (OLED) is deteriorates despite the electric current being constant. Accordingly, the second voltage sensed in the electric current source unit 182 may be used to determine a deterioration extent of the organic light emitting diode (OLED). The constant electric current supplied from the electric current source unit 182 is determined to extract the information of the deterioration of the organic light emitting diode (OLED). For example, a constant electric current may be set to an electric current value that will flow in the organic light emitting diode (OLED) when the pixel 140 emits the light with the maximum luminance.

The ADC 183 converts a first voltage supplied from the electric current sink unit 181 into a first digital value, and converts a second voltage supplied from the electric current source unit 182 into a second digital value.

The memory 191 stores the first digital value and the second digital value supplied to the ADC 183. The memory 191 stores a first digital value and a second digital value for each of the pixels 140 in the pixel unit 130. For this purpose, the memory 191 may be a frame memory.

The controller 192 supplies the first digital value and the second digital value to the timing controller 150, wherein the first digital value and the second digital value are extracted from the pixel 140 to which a first data (Data1) will be supplied, the first data (Data1) being received from the current timing controller 150.

The timing controller 150 receives a first data (Data1) from another circuit and receives a first digital value and a second digital value from the controller 192. The timing controller 150 receives the first digital value and the second digital value and generates a second data (Data2) based on the first data (Data1), the first digital value, and the second digital value to display an image having a uniform luminance.

For example, the timing controller 150 may generate the second data (Data2) based on the second digital value since by adding to the value of the first data (Data1) because the organic light emitting diode (OLED) has deteriorated. The second data (Data2) reflects the information about the deterioration of the organic light emitting diode (OLED), and therefore the timing controller 150 produces data which prevents light having a lower than desired luminance from being generated as the organic light emitting diode (OLED) deteriorates. Also, the timing controller 150 generates a second data (Data2) which compensates for variation in threshold voltage and/or mobility of the second transistor (M2), and therefore the display produces an image having a uniform luminance regardless of the threshold voltage and/or mobility variation of the second transistor (M2). The information about the threshold voltage and/or mobility of the second transistor (M2) is obtained using the first digital value.

The data driver 120 uses the second data (Data2) to generate a data signal and supplies the generated data signal to the pixel 140.

Figure 5:
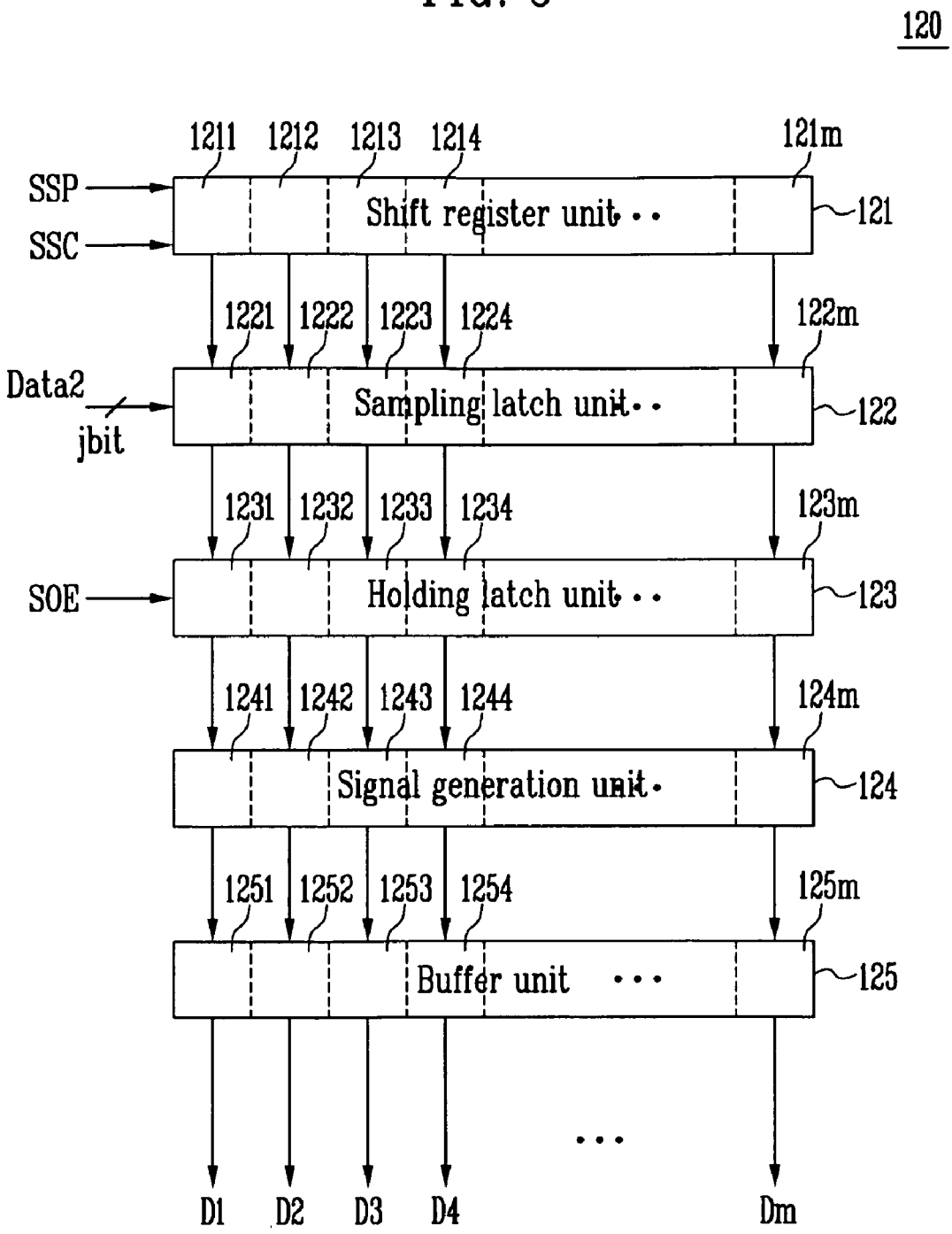
FIG. 5 is a block diagram showing an embodiment of a data driver shown in FIG. 2.

FIG. 5 is a diagram showing one embodiment of a data driver.

Referring to FIG. 5, the data driver 120 includes a shift register unit 121, a sampling latch unit 122, a holding latch unit 123, a signal generation unit 124, and a buffer unit 125.

The shift register unit 121 receives a source start pulse (SSP) and a source shift clock (SSC) from the timing controller 150. The shift register unit 121 receiving the source shift clock (SSC) and the source start pulse (SSP) sequentially generates the sampling signals while shifting the source start pulse (SSP) during every period of the source shift clock (SSC). For this purpose, the shift register unit 121 includes m shift registers (1211 to 121*m*). In some embodiments, m is greater than 9.

The sampling latch unit 122 sequentially stores the second data (Data2) in response to the sampling signal sequentially supplied from the shift register unit 121. For this purpose, the sampling latch unit 122 includes the m number of sampling latch 1221 to 122*m* so as to store the m number of the second data (Data2).

The holding latch unit 123 receives a source output enable (SOE) signal from the timing controller 150. The holding latch unit 123 receiving the source output enable (SOE) signal receives a second data (Data2) from the sampling latch unit 122 and stores the received second data (Data2). The holding latch unit 123 supplies the second data (Data2) stored therein to the signal generation unit 124. For this purpose, the holding latch unit 123 includes the m number of holding latches 1231 to 123*m*.

The signal generation unit 124 receives second data (Data2) from the holding latch unit 123, and generates the m number of data signals according to the received second data (Data2). For this purpose, the signal generation unit 124 includes the m number of digital-analog converters (hereinafter, referred to as "DAC") 1241 to 124*m*. That is to say, the signal generation unit 124 uses the DACs (1241 to 124*m*) arranged in every channel to generate the m number of data signals and supplies the generated data signals to the buffer unit 125.

The buffer unit 125 supplies the m data signals supplied from the signal generation unit 124 to each of the m number of the data lines (D1 to Dm). For this purpose, the buffer unit 125 includes the m number of buffers (1251 to 125*m*).

Figure 6A:
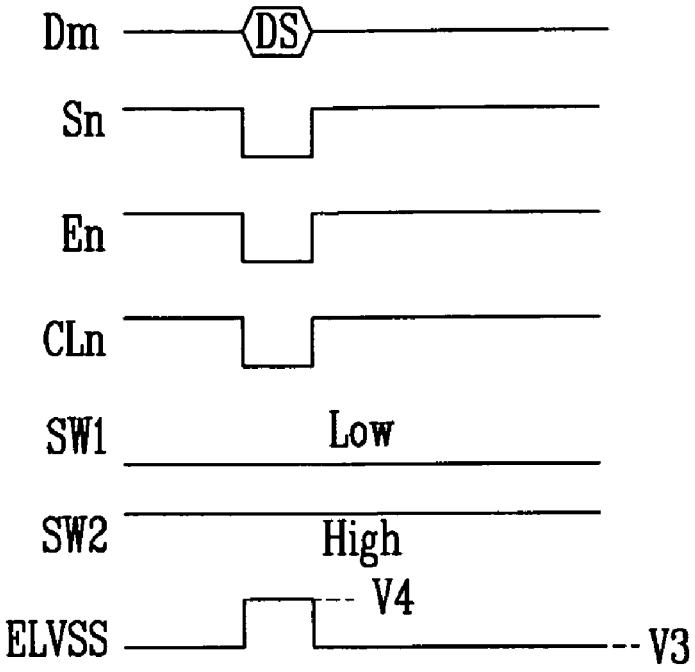
FIGS. 6*a*, 6*b* and 6*c* are waveform views showing a method for driving an organic light emitting display according to one embodiment.

FIG. 6*a* and FIG. 6*d* are diagrams showing a driving waveform supplied to the pixel and the switching unit.

FIG. 6*a* shows a waveform view for sensing information about a threshold voltage and/or mobility of the second transistor (M2) in the pixels 140. Only a scan signal supplied to an $n^{th}$ scan line (Sn) is shown in FIG. 6*a*, but the threshold voltage and/or mobility of the second transistor (M2) in all the pixels 140 is actually sensed while the scan signal is sequentially supplied to all of the scan lines (S1 to Sn). In the same manner, a waveform is supplied to the light emitting control line (En) and the control line (CLn) to synchronize with the scan signal. Meanwhile, the first switching element (SW1) is maintained in a turned-on state when the second transistor (M2) senses the threshold voltage and/or mobility.

Figure 7:
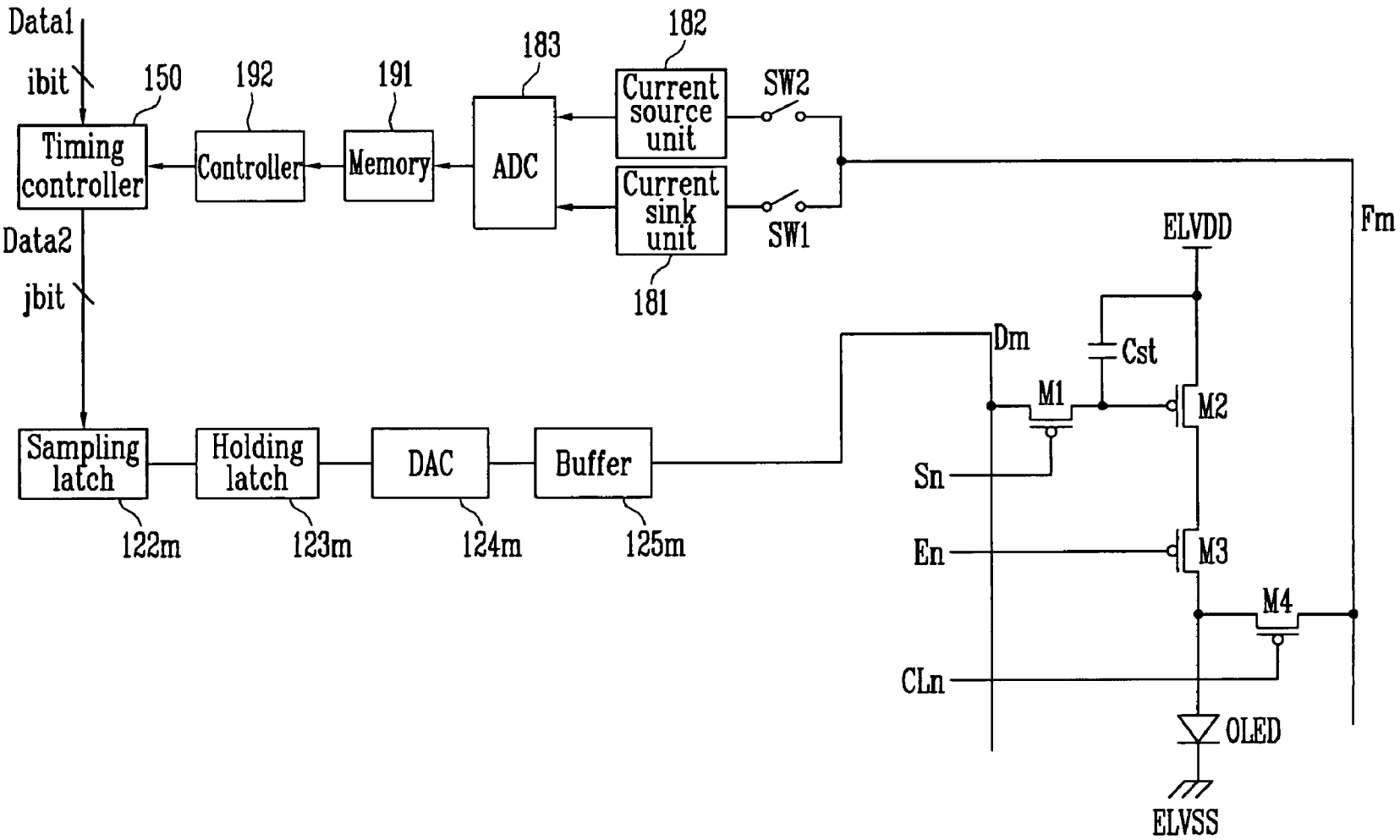
FIG. 7 is a block diagram showing a configuration where a data driver, a timing controller, a control block, a sensing unit and pixels are connected to each other.

An operation of the organic light emitting display will be described in more detail with reference to FIG. 6*a* and FIG. 7. First, a first transistor (M1) is turned on when a scan signal is supplied to the scan line (Sn), and a fourth transistor (M4) is turned on if a control signal is supplied to the control line (CLn). A third transistor (M3) is turned on since a light emitting control signal is not supplied to the light emitting control line (En) when the scan signal is supplied to the scan line (Sn).

If the first transistor (M1) is turned on, then the data line (Dm) is electrically connected to a gate electrode of the second transistor (M2). In addition, a data signal (DS) supplied to the data line (Dm) is supplied to the gate electrode of the second transistor (M2). If the data signal is supplied to the second transistor (M2), the second transistor (M2) supplies an electric current to a third transistor (M3) according to the certain data signal.

The voltage of the second power source (ELVSS) is increased from a third voltage (V3) to a fourth voltage (V4) during a period when the scan signal is supplied to the scan line (Sn). The voltage value of the fourth voltage (V4) is set so that an electric current cannot flow in the organic light emitting diode (OLED). Accordingly, the electric current supplied from the second transistor (M2) is supplied to the electric current sink unit 181 via the third transistor (M3) and the fourth transistor (M4). The electric current sink unit 181 generates the first voltage corresponding to the electric current supplied from the pixel 140, and supplies the generated voltage to the ADC 183.

The ADC 183 converts the first voltage, supplied from the electric current sink unit 181, to generate a first digital value, and supplies the first digital value to the memory 191, and therefore the first digital value is stored in the memory 191. Through the above-mentioned procedure, information of the threshold voltage and/or mobility of the second transistor (M2) in all of the pixels 140 is stored in the memory 191 as the first digital value.

The above-mentioned procedure of sensing threshold voltage and/or mobility of the second transistor (M2) is carried out at least once before the organic light emitting display is used. For example, first digital values extracted from all of the pixels 140 may be stored in the memory 191 before the organic light emitting display is distributed. Also, the procedure of sensing threshold voltage of the second transistor (M2) may be carried out by users.

Figure 6B:
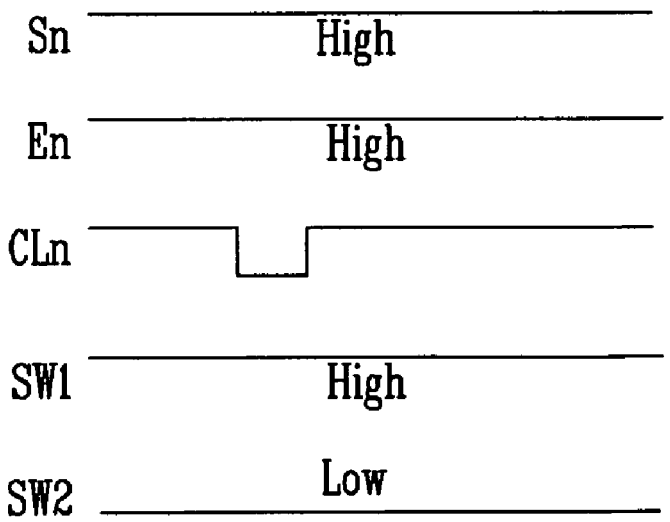

FIG. 6*b* shows a waveform view for sensing information of deterioration of the organic light emitting diodes in the pixels. Only a scan signal supplied to an $n^{th}$ scan line (Sn) is shown in FIG. 6*b*, but the information of deterioration of an organic light emitting diode included in all the pixels 140 is actually sensed while a control signal is sequentially supplied to all of the control lines (CL1 to CLn). Further, the second switching element (SW2) is maintained in a turned-on state when the information of deterioration of an organic light emitting diode is sensed.

An operation of the organic light emitting display will be described in more detail with reference to FIG. 6*b* and FIG. 7. First, a fourth transistor (M4) is turned on when a control signal is supplied to the control line (CLn). When the fourth transistor (M4) is turned on, a constant electric current supplied from the electric current source unit 182 is supplied to the second power source (ELVSS) via the fourth transistor (M4) and the organic light emitting diode (OLED). A second voltage is then applied to the organic light emitting diode (OLED) in response to the constant electric current, and the electric current source unit 182 supplies the second voltage to ADC 183.

The ADC 183 converts the second voltage, supplied from the electric current source unit 182, to create a second digital value and supplies the second digital value to the memory 191, which stores it. Through the above-described procedure, information of the deterioration of the organic light emitting diode (OLED) in all of the pixels 140 is stored in the memory 191 as a second digital value.

The above-described procedure of sensing information of the deterioration of the organic light emitting diode (OLED) may, for example, be carried out when the power source is supplied to the organic light emitting display. Consequently, an image having a desired luminance may be displayed by determining a level of the deterioration of the organic light emitting diode (OLED) whenever the power source is supplied to the organic light emitting display.

Figure 6C:
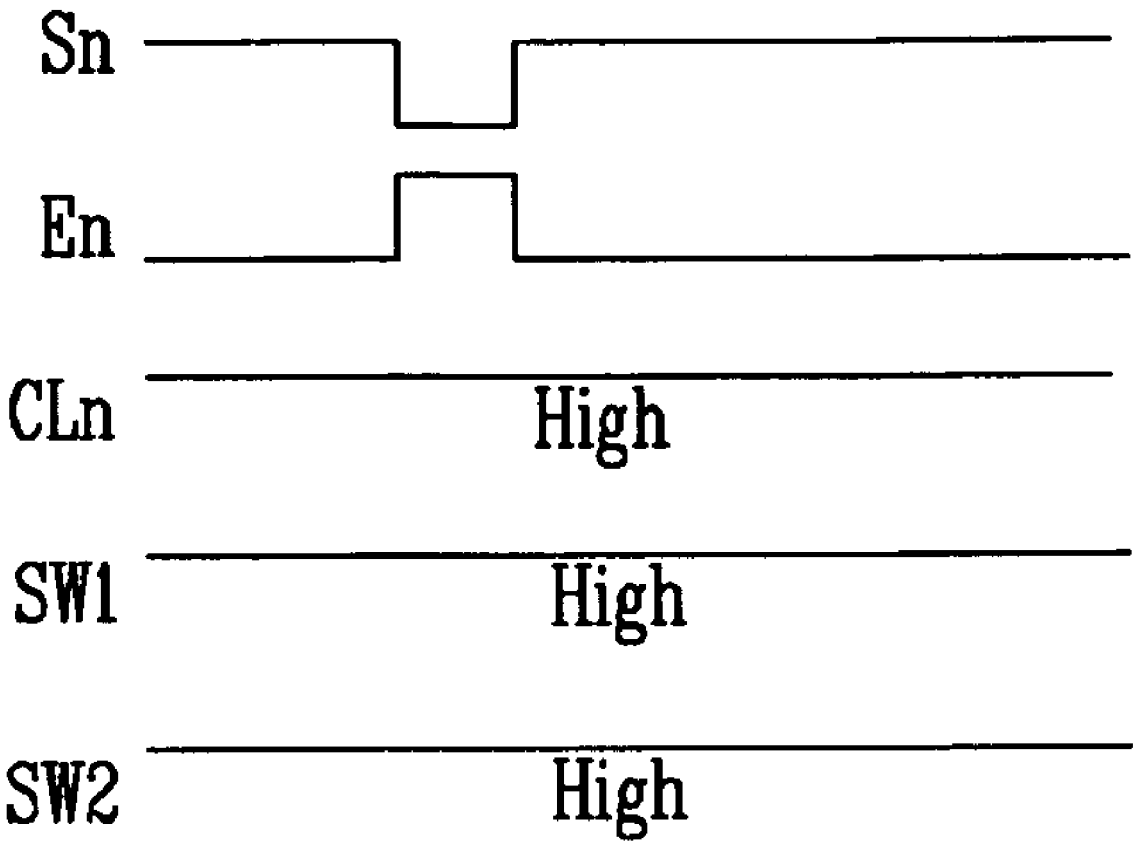

FIG. 6*c* shows a waveform view for carrying out a normal display operation.

During a normal display period, a scan signal is sequentially supplied to the scan lines (S1 to Sn), and a light emitting control signal is sequentially supplied to the light emitting control lines (E1 to En). Also, the first switching element (SW1) and the second switching element (SW2) are maintained in a turned-off state during the normal display period.

An operation of the organic light emitting display will be described in more detail with reference to FIG. 6*c* and FIG. 7. First, a first data (Data1) for the pixel 140 connected with the data line (Dm) and the scan line (Sn) is supplied to the timing controller 150. The controller 192 supplies a first digital value and a second digital value to the timing controller 150, the first digital value and the second digital value being extracted from the pixel 140 connected with the data line (Dm) and the scan line (Sn).

The timing controller 150 receiving the first digital value and the second digital value generates a second data (Data2) based on the first data (Data1), and the first and second digital values. Here, the second data (Data2) compensates for the deterioration of the organic light emitting diode (OLED) and the variation in threshold voltage and/or mobility of the second transistor (M2).

For example, "00001110" may be input as the first data (Data1), and the timing controller 150 may generate "000011110" as the second data (Data2) so as to compensate for the deterioration of the organic light emitting diode (OLED). In this case, the timing controller 150 may compensate for the deterioration of the organic light emitting diode (OLED) based on the second data (Data2). In the same manner, the timing controller 150 may generate the second data (Data2) so that it can also compensate for variation in the threshold voltage and/or mobility of the second transistor (M2).

The second data (Data2) generated in the timing controller 150 is supplied to a DAC 124*m* via a sampling latch 122*m* and a holding latch 123*m*. Then, the DAC 124*m* uses the second data (Data2) to generate a data signal, and supplies the generated data signal to the data line (Dm) via a buffer 125*m*.

Since the first transistor (M1) is turned on if the scan signal is supplied to the scan line (Sn), the data signal supplied to the data line (Dm) is supplied to the gate electrode of the second transistor (M2). Accordingly, the storage capacitor (Cst) is charged with a voltage corresponding to the data signal. Further, unnecessary electric current may be prevented from being supplied to the organic light emitting diode (OLED) during a period when the voltage corresponding to the data signal is charged in the storage capacitor (Cst) because the third transistor (M3) is turned off by means of the light emitting control signal supplied to the light emitting control line (En).

Then, the first transistor (M1) is turned off when the scan signal is suspended, and the third transistor (M3) is turned on when the light emitting control signal is suspended. The second transistor (M2) supplies an electric current to the organic light emitting diode (OLED), the electric current corresponding to the voltage of the storage capacitor (Cst). Consequently, the organic light emitting diode (OLED) generates light having luminance corresponding to the electric current.

The information of the deterioration of the organic light emitting diode (OLED) may be obtained when the power source is supplied to the organic light emitting display shown in FIG. 6*b*, but the present invention is not limited thereto.

Figure 8:
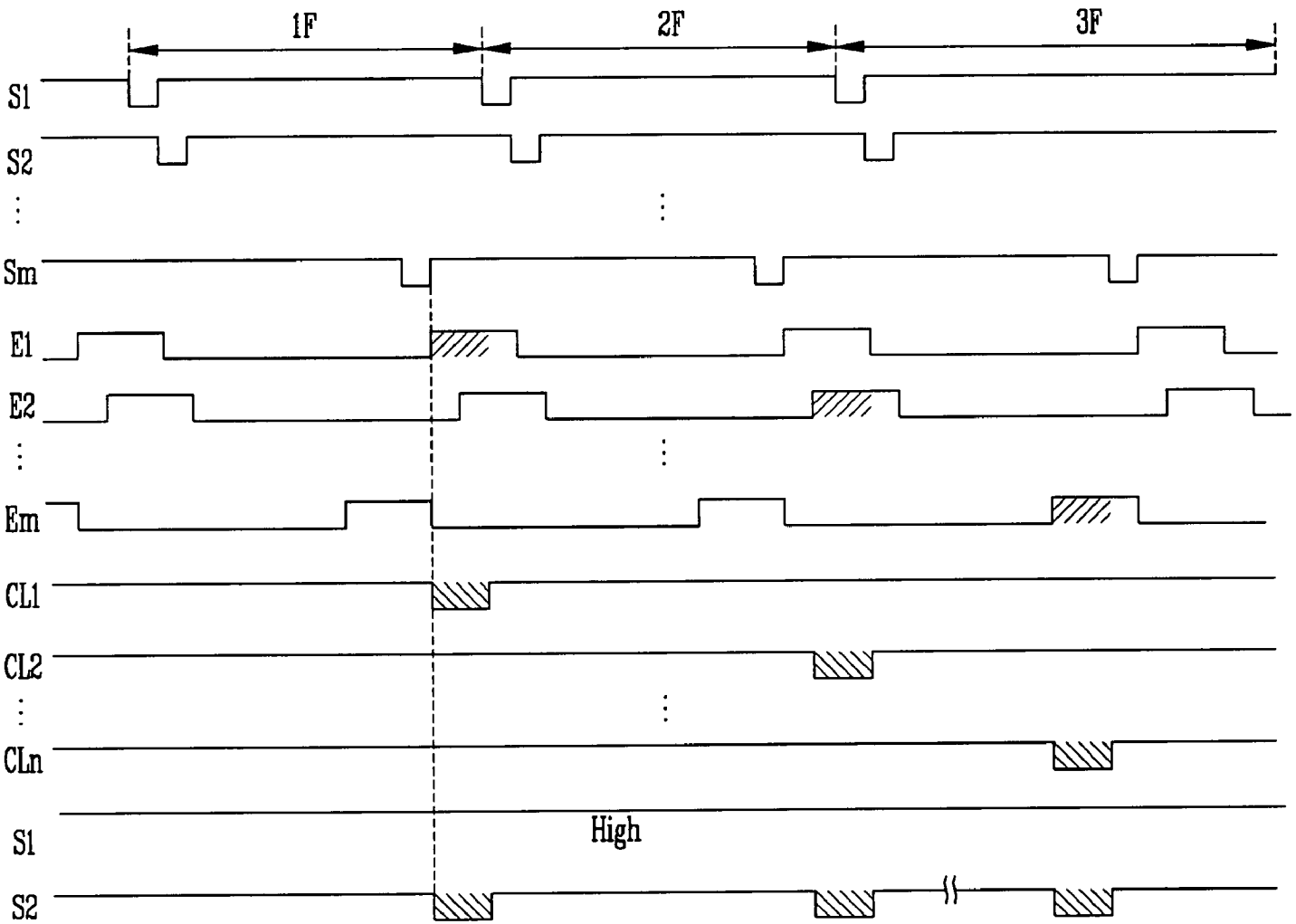
FIG. 8 is a waveform view showing a method for driving an organic light emitting display according to another embodiment.

FIG. 8 is a waveform view showing that information of deterioration of the organic light emitting diode may be extracted while a normal display operation is carried out.

An operation of the organic light emitting display will be described in more detail with reference to FIG. 7 and FIG. 8. First, a scan signal is sequentially supplied to the scan lines (S1 to Sn) during each of frame periods. If a data signal is supplied to the data lines (D1 to Dm) to synchronize with the scan signal, a voltage corresponding to the data signal is stored in the pixels 140.

A light emitting control signal is sequentially supplied to the light emitting control lines (E1 to En) during each of the frame periods. The pixels 140 are set to a non-light emission state when the light emitting control signal is supplied. Accordingly, luminance of the pixels 140 can be controlled by controlling the duration of the light emitting control signal supplied to the light emitting control lines (E1 to En). The pixels 140 generate light having a luminance corresponding to the data signal during a period when the supply of the light emitting control signal is suspended.

The duration of the light emitting control signal may be longer than the scan signal. Accordingly, the pixels 140 have a certain non-display period after the scan signal is supplied in a current frame and before a scan signal is supplied in the next frame.

The information of the deterioration of the organic light emitting diode is sensed during the non-display period, as described above.

As shown, a control signal is supplied to the first control line (CL1) during the non-display period of the pixels 140 which are connected to the first scan line (S1) during a first frame (1F) period. The second switching element (SW2) is turned on when the control signal is supplied to the first control line (CL1).

If the control signal is supplied to the first control line (CL1), the fourth transistor (M4) is turned on, the fourth transistor (M4) being included in each of the pixels 140 connected to the first scan line (S1). If the fourth transistor (M4) is turned on, the organic light emitting diode (OLED) and the feedback lines (F1 to Fm) are electrically connected to each other. At this time, the constant electric current supplied from the electric current source units 182 is supplied to the organic light emitting diode (OLED) since the second switching element (SW2) is turned on, and therefore a second voltage is generated. The second voltage is supplied to the electric current source units 182 via the feedback lines (F1 to Fm), and the electric current source units 182 supplies the second voltage to an ADC 183. The ADC 183 converts second voltages, supplied from the electric current source units 182, into a second digital value, and stores the converted second digital value in the memory 191.

A control signal is supplied to the second control line (CL2) during the non-display period of the pixels 140 which are connected to the second scan line (S2) during a second frame (2F) period. Further, the second switching element (SW2) is turned on during a period when the control signal is supplied to the second control line (CL2).

If the control signal is supplied to the second control line (CL2), a fourth transistor (M4) is turned on, the fourth transistor (M4) being in each of the pixels 140 connected with the second scan line (S2). If the fourth transistor (M4) is turned on, the organic light emitting diode (OLED) and the feedback lines (F1 to Fm) are electrically connected to each other. At this time, an electric current supplied from the electric current source units 182 is supplied to the organic light emitting diode (OLED) since the second switching element (SW2) is turned on, and therefore a second voltage is generated. The second voltage is supplied to the electric current source units 182 via the feedback lines (F1 to Fm), and the electric current source units 182 supplies the second voltage to an ADC 183. The ADC 182 converts the second voltages, supplied from the electric current source unit 182, into second digital values and stores the converted second digital values in the memory 191.

This procedure may be repeated to extract information of the deterioration of the organic light emitting diode (OLED), for example, in a horizontal line.

The transistors included in the pixel 140 are PMOS transistors as shown in FIG. 3, but the present invention is not limited thereto. For example, all of the transistors included in the pixel 140 may be NMOS transistors. In this case, the polarity of the driving waveform for the NMOS transistors is opposite to the polarity of the PMOS transistors, as is well known in the art.

As described above, the information of the threshold voltage and/or mobility of the drive transistor is stored by sinking the electric current supplied from the pixels according to a certain data signal, and the information of the deterioration of the organic light emitting diode is stored while supplying an electric current to the pixels.

The second data is also generated to compensate for the variation in threshold voltage and/or mobility and deterioration of the organic light emitting diode using the stored information, and the generated data signal is supplied to the pixels using the second data. Accordingly, the organic light emitting display can display an image having a uniform luminance regardless of the deviations in the deterioration of the organic light emitting diode and the threshold voltage and/or mobility of the drive transistor.

The description herein relates various examples for the purpose of illustrations only, and are not intended to limit the scope of the invention, so it should be understood that other equivalents and modifications could be made without departing from the spirit and scope of the invention.

What is claimed is:

1. An organic light emitting display, comprising:

a plurality of pixels located near intersections of data lines, scan lines, power lines, and light emitting control lines;

a scan driver configured to supply a scan signal to the scan lines and to supply a light emitting control signal to the light emitting control lines;

a control line driver configured to supply a control signal to control lines;

a data driver configured to generate a data signal for the data lines;

a sensing unit configured to sense information about at least one of deterioration of an organic light emitting diode, voltage threshold of a drive transistor, and mobility of the drive transistor via feedback lines, the organic light emitting diode and the drive transistor being in each of the pixels;

a control block configured to store the sensed information; and a timing controller configured to generate the second data based on the sensed information and a first data supplied from another circuit, wherein the sensing unit comprises:

an electric current sink unit for each of a plurality of channels, each sink unit configured to receive an electric current from a selected one of the pixels;

an electric current source unit for each of the channels, each source unit configured to supply an electric current to the selected pixel; and an analog-digital converter configured to generate a first digital value based on information of threshold voltage and/or mobility received from the electric current sink unit and to generate a second digital value based on information of deterioration of the organic light emitting diode received from the electric current source unit.

2. The organic light emitting display according to claim 1, wherein each of the channels comprises:

a first switching element located between the electric current sink unit and the feedback line and configured to be turned on when the information of the threshold voltage and/or mobility is sensed; and a second switching element located between the electric current source unit and the feedback line and configured to be turned on when the information of the deterioration of the organic light emitting diode is sensed.

3. The organic light emitting display according to claim 2, wherein the control block comprises:

a memory configured to store the first digital value and the second digital value; and a controller configured to transmit the first digital value and the second digital value to the timing controller.

4. The organic light emitting display according to claim 3, wherein the controller of the control block is configured to supply the first digital value and the second digital value corresponding to a certain pixel to the timing controller when the first data for the certain pixel is input into the timing controller.

5. The organic light emitting display according to claim 3, wherein the second digital value has a greater number of bits than the first data.

6. The organic light emitting display according to claim 5, wherein the second data has a value which compensates for deterioration of the organic light emitting diode and threshold voltage and/or mobility of a drive transistor in the one pixel circuit.

7. The organic light emitting display according to claim 5, wherein each of the pixels comprises:

an organic light emitting diode;

a first transistor connected to the scan line for the pixel and the data line for the pixel, the first transistor configured to be turned on when a scan signal is supplied to the scan line for the pixel;

a storage capacitor configured to store a voltage corresponding to the data signal supplied to the data line for the pixel;

a drive transistor configured to supply an electric current to the organic light emitting diode, the current corresponding to the voltage stored in the storage capacitor;

a third transistor located between the drive transistor and the organic light emitting diode and configured to be turned off when a light emitting control signal is supplied to the light emitting control line; and a fourth transistor located between an anode electrode of the organic light emitting diode and the feedback line, and configured to be turned on when a control signal is supplied to the control line.

8. The organic light emitting display according to claim 7, wherein a data signal is supplied to the data line of the pixel when the information of the threshold voltage and/or mobility information is sensed and the data signal is supplied to the gate electrode of the drive transistor when the first transistor is turned on.

9. The organic light emitting display according to claim 8, wherein the third transistor and the fourth transistor are configured to be turned on when the information of the threshold voltage and/or mobility is sensed and an electric current from the drive transistor is supplied to the electric current sink unit.

10. The organic light emitting display according to claim 9, wherein the cathode electrode of the organic light emitting diode is supplied with a voltage to prevent the electric current from the drive transistor from flowing through the organic light emitting diode when the information of the threshold voltage and/or mobility is sensed.

11. The organic light emitting display according to claim 9, wherein the electric current sink unit is configured to generate a first voltage according to the electric current supplied from the drive transistor, and the analog-digital converter is configured to convert the first voltage into a first digital value.

12. The organic light emitting display according to claim 9, wherein the sensing of the information of the threshold voltage and/or mobility is carried out at least once before the organic light emitting display is distributed.

13. The organic light emitting display according to claim 7, wherein, when the information about deterioration of the organic light emitting diode is sensed, the fourth transistor is turned on to allow the electric current, supplied from the electric current source unit, to flow in the organic light emitting diode.

14. The organic light emitting display according to claim 13, wherein the second voltage, generated when the electric current flows in the organic light emitting diode, is converted into the second digital value.

15. The organic light emitting display according to claim 14, wherein the information of the deterioration of the organic light emitting diode is sensed at least once when a power source is supplied to the organic light emitting display.

16. The organic light emitting display according to claim 13, wherein, when the light emitting control signal is supplied to pixels connected with an $i^{th}$ (i is an integer) scan line during a $k^{th}$ (k is an integer) frame period, the information of the deterioration of the organic light emitting diode is sensed when pixels connected with the $i^{th}$ scan line is set to a non-light emission state, the organic light emitting diode being included in each of the pixels connected with the $i^{th}$ scan line.

* * * * *